US008398058B2

(12) United States Patent
Dotsey

(10) Patent No.: US 8,398,058 B2
(45) Date of Patent: Mar. 19, 2013

(54) UNIVERSAL BRACKET

(75) Inventor: Michael Dotsey, Pottstown, PA (US)

(73) Assignee: AZEK Building Products, Inc., Scranton, PA (US)

( * ) Notice: Subject to any disclaimer, the term of this patent is extended or adjusted under 35 U.S.C. 154(b) by 400 days.

(21) Appl. No.: 12/819,430

(22) Filed: Jun. 21, 2010

(65) Prior Publication Data

US 2011/0308195 A1 Dec. 22, 2011

(51) Int. Cl.
*E04H 17/00* (2006.01)

(52) U.S. Cl. ..... 256/67; 256/65.07; 256/65.08; 256/65.16

(58) Field of Classification Search ..... 256/59, 256/60, 67, 65.02, 65.03, 65.04, 65.05, 65.06, 256/65.07, 65.08, 65.16, 21; 403/113, 114
See application file for complete search history.

(56) References Cited

U.S. PATENT DOCUMENTS

| | | | | |
|---|---|---|---|---|
| 1,663,203 | A * | 3/1928 | Luipersbek | 256/67 |
| 4,150,907 | A | 4/1979 | Thurnauer | |
| 4,928,930 | A | 5/1990 | Chung | |
| 5,437,433 | A * | 8/1995 | Rezek | 256/67 |
| 5,547,169 | A * | 8/1996 | Russell | 256/67 |
| 5,695,175 | A | 12/1997 | Hawkins | |
| 6,736,373 | B2 * | 5/2004 | Greaves | 256/65.16 |
| 7,540,472 | B2 * | 6/2009 | Striebel et al. | 256/67 |
| 7,992,841 | B2 * | 8/2011 | Petta et al. | 256/65.07 |
| 2004/0188666 | A1 * | 9/2004 | Pratt | 256/65.07 |
| 2007/0246698 | A1 | 10/2007 | Truckner | |
| 2010/0025649 | A1 | 2/2010 | Ward | |

* cited by examiner

*Primary Examiner* — Michael P Ferguson
(74) *Attorney, Agent, or Firm* — Buchanan Ingersoll & Rooney PC

(57) ABSTRACT

A universal handrail support bracket is disclosed in which a bracket is configured to be mounted to a handrail or banister and the bracket has an annular ring attached thereto. The annular ring has a concave interior surface and a convex exterior surface. A curved nut and a cap have surfaces which mate with respectively the inner and outer surfaces of the annular ring. The curved nut and the cap are positioned respectively inside and upon the annular ring such that they may both freely rotate and pivot. A fastener such as a screw passes through both the curved nut and the cap and into a fixed substantially vertical surface such that the bracket may be attached to the fixed substantially vertical surface at any desired pitch angle, yaw angle, and roll angle for attaching a rail to a vertical surface.

14 Claims, 3 Drawing Sheets

UNIVERSAL BRACKET

FIELD OF THE INVENTION

The present invention relates generally to the field of construction assemblies. More specifically, the invention relates to the field of railing assemblies for staircases, ramps, or the like, and connectors used to affix the rail to a fixed substantially vertical surface.

BACKGROUND OF THE INVENTION

Boundary systems are commonly used in conjunction with staircases, ramps, or the like to prevent people from falling over the edge of these structures. Integral to such boundary systems are rail members parallel to the edge of the staircase or ramp, commonly known in the art as handrails or banisters. Such handrails or banisters may be anchored to a fixed substantially vertical surface, for example a wall or a newel post, via a butt joint of a terminal end of the handrail or banister. Such butt joints are typically formed with fasteners that connect a handrail or banister to a wall or other vertical surface.

Examples of boundary systems may be appreciated from U.S. Pat. Nos. 5,437,433 and 4,928,930, and from U.S. Patent Publication No. 2007/0246698. Such systems may include a series of vertical support members that extend from the railing to a base. Each support may have a connector or connectors that allow the installer to adjust the angle between the support and the railing so the support members engage the handrail or banister at a desired pitch angle. Such connectors are not useful for connecting end portions of a handrail or banister to a vertical surface. Instead, those connectors are configured to support the handrail or banister and to provide a connection between the handrail or banister and lower support members, such as balusters or posts.

U.S. Pat. No. 4,150,907 teaches the use of a stanchion connector assembly adapted to provide an anchor for the terminal end of a handrail or banister. The stanchion connector assembly is configured to be secured to a stanchion at a series of angles defined by a slot formed in a portion of the connector assembly. This slot extends vertically and is configured to receive a screw for fastening an end of a handrail or banister to the stanchion at any number of positions defined by the vertically extending slot.

The amount of adjustment possible in the apparatus disclosed in U.S. Pat. No. 4,150,907 is thus limited by the length of the slot. Rotation of the handrail or banister against the anchor is only possible to the extent that the slot remains aligned with an aperture for receiving a fastener. The adjustability provided by the slot is only provided along one axis.

The pitch angle of the rail is adjustable within the physical constraints of the anchor and the slot, but no side-to-side rotation, commonly referred to as the yaw angle, is possible. Furthermore, it is not possible to rotate the apparatus around the aperture in the anchor, commonly referred to as the roll angle. As such, it is not possible to securely fasten the rail member at any yaw angle without the use of shims or cutting into the surface to which the connector is attached. If the mounting surface is warped or curved or irregular the installer may spend considerable time cutting the mounting surface or installing shims to obtain a secure joint with a conventional connector. Furthermore, a person who has limited carpentry skills may never be able to create a secure joint in these situations.

Railing systems currently available in the market are sold with connectors that are pre-configured at the time of manufacture to the particular pitch angle, yaw angle, and roll angle required, or a connector that is adjustable with respect to the pitch angle only. These connectors are useful in most installations because the railing is not being attached to a curved or warped surface. Should the installer encounter a curved or warped surface or be required to mount the rail at a non-standard angle, the installer must make an on-site adaptation of the mounting surface or the connector or both to make a secure joint. This is inconvenient and increase the time required to install the railing. Furthermore, such adaptation of the fixed substantially vertical surface or of the connector may be beyond the purview of person with limited carpentry skills such as a "do-it-yourself" homeowner.

A new connector for effecting a butt joint between a rail member and a fixed substantially vertical surface is needed which provides for the adjustment of the pitch angle, the yaw angle, and the roll angle in a manner easy enough to be employed by a homeowner or other person unskilled in carpentry or the like.

SUMMARY OF THE INVENTION

A connector assembly is provided which includes a bracket, an annular ring attached to the bracket, a curved nut located in the annular ring, and a cap located upon the annular ring. The bracket is configured to be mounted to a rail member. The annular ring has a concave interior surface and a convex exterior surface both of which are spherically shaped. The annular ring has a front face with an interior diameter. The annular ring is connected to the bracket via a tab extending from the front face. The curved nut has a convex front surface that mates with the concave interior surface of the annular ring. The curved nut has a central bore extending through the curved nut. The central bore of the curved nut has an interior diameter substantially smaller than the interior diameter of the front face of the annular ring. The curved nut is positioned within the annular ring so that it may freely rotate and pivot. The cap has a concave interior surface that defines a chamber and mates with the convex exterior surface of the annular ring. The cap has an aperture through which a mounting screw may pass. The aperture of the cap has an interior diameter substantially smaller than the interior diameter of the front face of the annular ring. The cap is positioned on or over the annular ring so that the annular ring may freely rotate and pivot relative to the cap. The central bore of the curved nut and the aperture of the cap are aligned such that they may accept a fastener such as a screw. Both the curved nut and the cap may freely rotate in tandem when the fastener such as a screw passes through the central bore of the curved nut and through the aperture of the cap and into the fixed substantially vertical surface.

The annular ring may be attached via the tab to the bracket at a substantially ninety degree angle. The bracket may have one or more holes for receiving a fastener. The bracket may have parallel bent ends that form a channel which mates with a rail member. It is contemplated that the annular ring and the bracket may be an integrally formed unit. It is also contemplated that the tab may be bendable such that the annular ring may be moved relative to the bracket. At least one of the bracket or the annular ring may be made of aluminum, iron, brass, steel, stainless steel, or other metal alloy.

Preferably the cap has a front surface which may be flat. The cap may be substantially cylindrical. At least one of the curved nut or the cap may be made of aluminum, iron, brass, steel, stainless steel, or other metal alloy. Both the curved nut and the cap may rotate and pivot within or on the annular ring along a pitch angle, a yaw angle, a roll angle, or any combination thereof.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of my universal handrail support bracket are shown in the accompanying drawings, and certain present preferred methods of practicing the same are also illustrated therein.

DESCRIPTION OF PRESENT PREFERRED EMBODIMENTS

Figure 1A:
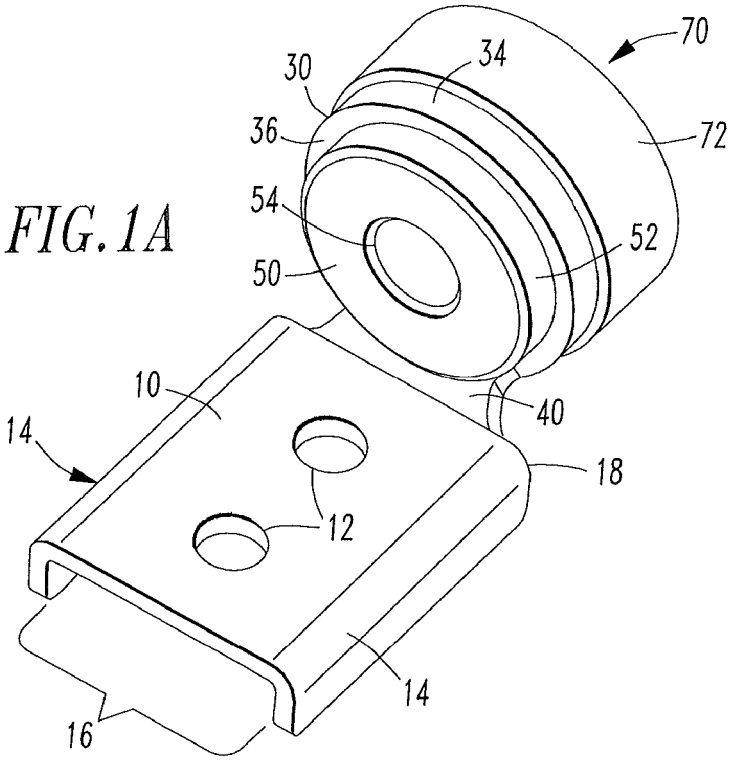
FIG. 1A is a perspective view of a first presently preferred embodiment of an assembled universal handrail support bracket.
Figure 1B:
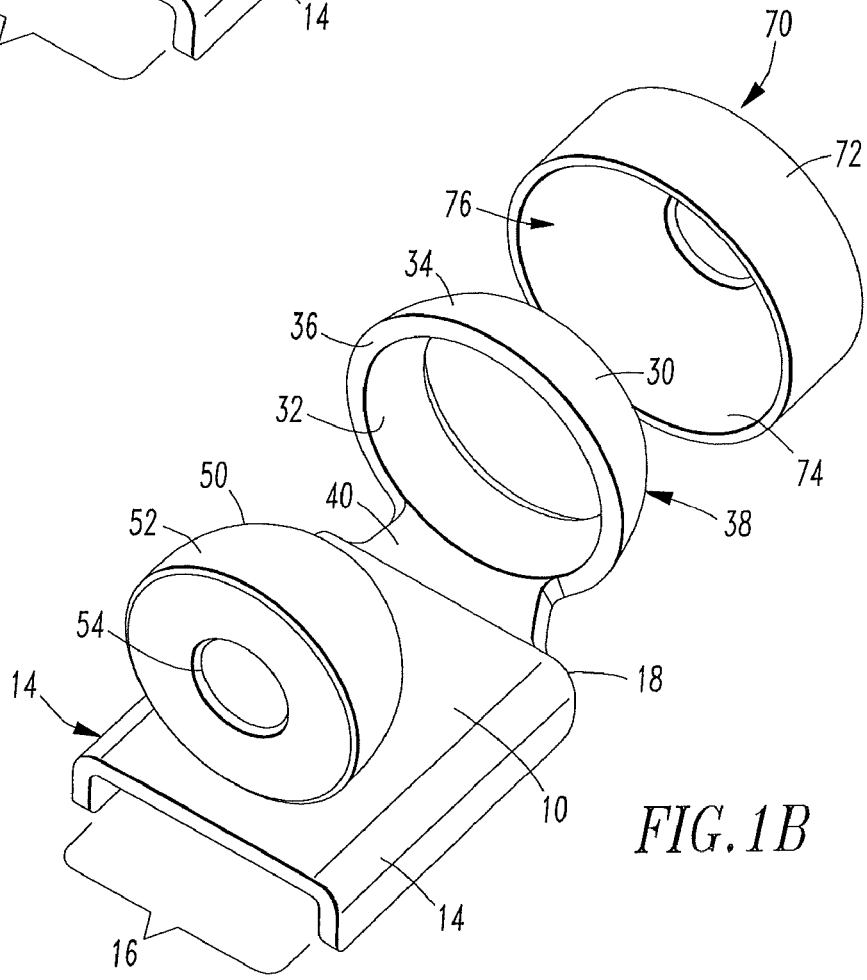
FIG. 1B is an exploded view of the first presently preferred embodiment of the universal handrail support bracket shown in FIG. 1A.
Figure 2:
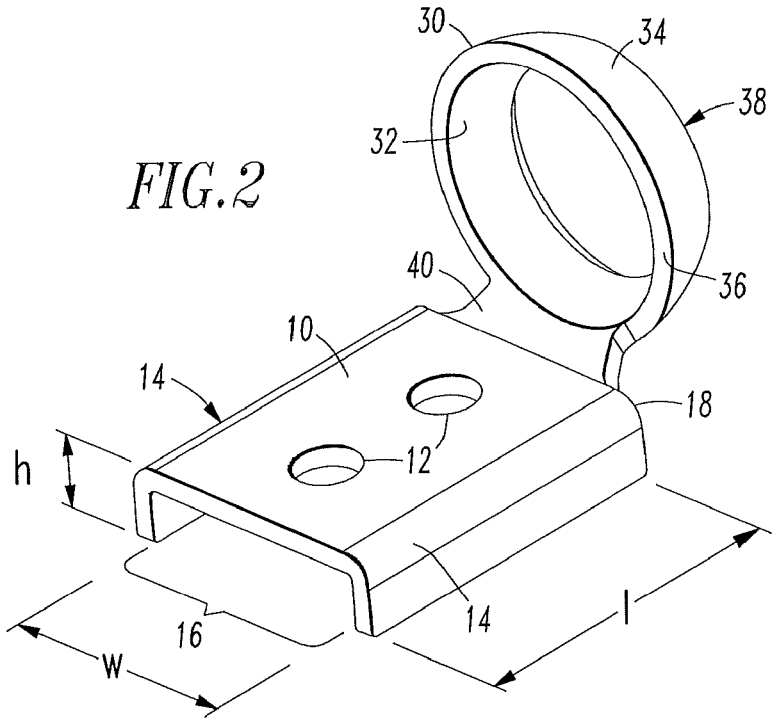
FIG. 2 is a perspective view of a presently preferred bracket attached to a presently preferred annular ring that may be utilized in embodiments of the universal handrail support bracket.

Referring to FIGS. 1A, 1B and 2, a bracket 10 may have attached thereto an annular ring 30 via a tab 40 which extends from a front face 36 of the annular ring 30 and connects to the bracket 10. The front face 36 of the annular ring 30 is sized and configured to receive a curved nut 50 having a central bore 54. The curved nut 50 is sized and configured for positioning within the central opening of the annular ring 30. A cap 70 having an aperture 78 that is alignable with the central bore 54 of the curved nut 50 is positioned over the annular ring 30 and may cover a portion of the annular ring 30.

As may be appreciated from FIG. 2, the annular ring 30 has a tab 40 that is configured to connect the front face 36 of the annular ring 30 to the bracket 10. Preferably, the annular ring 30 is integral with the tab 40 and the bracket 10 such that the bracket 10, the tab 40, and the annular ring 30 are a unitary structure. The bracket 10 is configured to be mounted to a rail member (shown in FIGS. 5 and 6) by for example passing screws through screw holes 12 for attaching the bracket 10 to the rail member. Although less preferred, it is also contemplated that the bracket 10 may be mounted to the rail member via other means, such as for example adhesives like epoxy or glue, or other fastening mechanisms.

The bracket 10 may also have parallel bent ends 14 forming a channel 16 on the underside of the bracket 10. The bent ends 14 of the channel 16 may be sized and configured to mate with a portion of a rail member to provide a desired aesthetic effect or to aid in the fastening of the bracket 10 to the rail member. Preferably, the annular ring 30 is attached via the tab 40 to an end 18 of the bracket 10 between the bent ends 14 of the bracket 10 and adjacent to an end of the channel 16.

The bracket 10 has a length l and a width w at a substantially ninety degree angle to the length l defining a rectangular shape. The end 18 of the bracket 10 defines the width w. The bracket 10 may also have a height h defined by the bent ends 14. Preferably the length l is 1.18 inches, the width w is 0.84 inches, and the height h is 0.27 inches. Of course, the length l, the width w, and the height h, may have different dimensions to meet a particular design objective or to provide a desired aesthetic effect. Though less preferred, the bracket 10 need not be rectangular shaped to meet a particular design objective or to provide a desired aesthetic effect.

The annular ring 30 has a concave interior surface 32 and a convex exterior surface 34. The annular ring has a front face 36 and a rear face 38. The front face 36 of the annular ring 30 has an interior diameter, as does the rear face 38 of the annular ring 30. The interior diameter of the front face 36 of the annular ring 30 is larger than the interior diameter of the rear face 38 of the annular ring 30. Preferably the interior diameter of the front face 36 of the annular ring 30 is 0.884 inches and the interior diameter of the rear face 38 of the annular ring 30 is 0.732 inches.

The concave interior surface 32 of the annular ring 30 is spherically curved from the front face 36 of the annular ring 30 to the rear face 38 of the annular ring 30, as is the convex exterior surface 34 of the annular ring 30. The interior surface 32 is configured to cover at least a portion of the curved nut 50.

A tab 40 extends from the front face 36 of the annular ring 30 connecting the annular ring 30 to the bracket 10. The tab 40 may be curved to match the curvature of the exterior surface 34 of the annular ring 30. Of course, the tab 40 may have other shapes and configurations as well to meet a particular design objective or to provide a desired aesthetic effect.

The annular ring 30 is preferably attached via the tab 40 to the bracket 10 such that the plane defined by the front face 36 of the annular ring 30 is perpendicular to the plane defined by the length l and the width w of the bracket 10. The tab 40 may be at least partially bendable, allowing the annular ring 30 to be resiliently moved relative to the bracket 10.

At least one of the bracket 10 and the annular ring 30 may be made from metal, such as aluminum, iron, brass, steel, stainless steel, type 316 stainless steel, or other metal alloy. It is contemplated that at least one of the bracket 10 and the annular ring 30 may be made from other materials, such as for example polymeric material, ceramic material, or a composite material.

Figure 3:
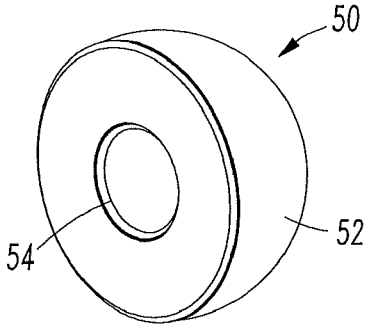
FIG. 3 is a perspective view of a presently preferred curved nut that may be utilized in embodiments of the universal handrail support bracket.

Referring to FIG. 3, a curved nut 50 has a convex front surface 52 and a central bore 54 extending through the curved nut 50. The convex front surface 52 of the curved nut 50 is semi-spherical and is sized and configured to mate with the concave interior surface 32 of the annular ring 30. The central bore 54 has an interior diameter large enough to accept a fastener such as for example a screw or a bolt. Because the concave interior surface 32 of the annular ring 30 mates with the convex front surface 52 of the curved nut 50, the curved nut 50 may freely rotate and pivot in any direction when positioned within the annular ring 30. Such movability may permit the curved nut 50 to be adjusted along a pitch angle, a yaw angle, a roll angle, or any combination thereof when positioned at least partially within the annular ring 30.

Figure 4:
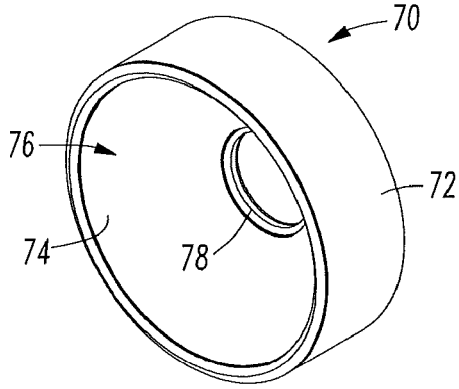
FIG. 4 is a perspective view of a presently preferred cap that may be utilized in embodiments of the universal handrail support bracket.

Referring to FIG. 4, a cap 70 has a front surface 72 and a concave interior surface 74 that defines a chamber 76. An aperture 78 is located in the front surface 72 of the cap 70 and communicates with the chamber 76 defined by the concave interior surface 74. The aperture 78 has an interior diameter that is large enough to accept a fastening means such as for example a screw or a bolt. The concave interior surface 74 of the cap 70 is semi-spherical and mates with the convex exterior surface 34 of the annular ring 30. Because the convex exterior surface 34 of the annular ring 30 mates with the concave interior surface 74 of the cap 70, the cap 70 may freely rotate and pivot in any direction when positioned on or over the annular ring 30. Such movability may permit the cap 70 to be adjusted along a pitch angle, a yaw angle, a roll angle, or any combination thereof. Preferably the cap 70 is substantially cylindrical or substantially tubular.

Preferably the central bore 54 of the curved nut 50 and the aperture 78 of the cap 70 are smooth having no threads. Of course, alternate embodiments of the universal handrail support bracket may include a curved nut 50 that has a threaded central bore 54 to engage a fastener such as a screw or a bolt, or a cap 70 that has a threaded aperture 78 to engage a fastener such as a screw or a bolt.

At least one of the curved nut 50 and the cap 70 may be made from metal, such as aluminum, iron, brass, steel, stainless steel, type 6061-T6 aluminum, or other metal alloy. It is contemplated that at least one of the curved nut 50 and the cap 70 may be made from other materials, such as for example polymeric material, ceramic material, or a composite material.

When the curved nut 50 is positioned inside the annular ring 30 and the cap 70 is positioned on or over the annular ring 30, the central bore 54 of the curved nut 50 may be aligned with the aperture 78 of the cap 70. This arrangement may be appreciated from FIG. 1A and FIG. 1B. If a fastener, such as a screw, is passed through first the central bore 54 of the curved nut 50 within the annular ring 30, the annular ring 30, and then the aperture 78 of the cap 70 on or over the annular ring 30, the curved nut 50 and the cap 70 may be rotated and pivoted via movement of the fastener to adjust the pitch angle, yaw angle, roll angle, or any combination thereof at the same time.

It should be appreciated that such rotation and pivoting may be limited by the diameter of the fastening means, such as for example a screw, and the interior diameter of the front face 36 of the annular ring 30 and the interior diameter of the rear face 38 of the annular ring 30.

In a preferred embodiment, the interior diameter of the central bore 54 of the curved nut 50 and the interior diameter of the aperture 78 of the cap 70 are substantially one-half the interior diameter of the front face 36 of the annular ring 30, which has been found to permit a wide range of rotating and pivoting.

Figure 5:
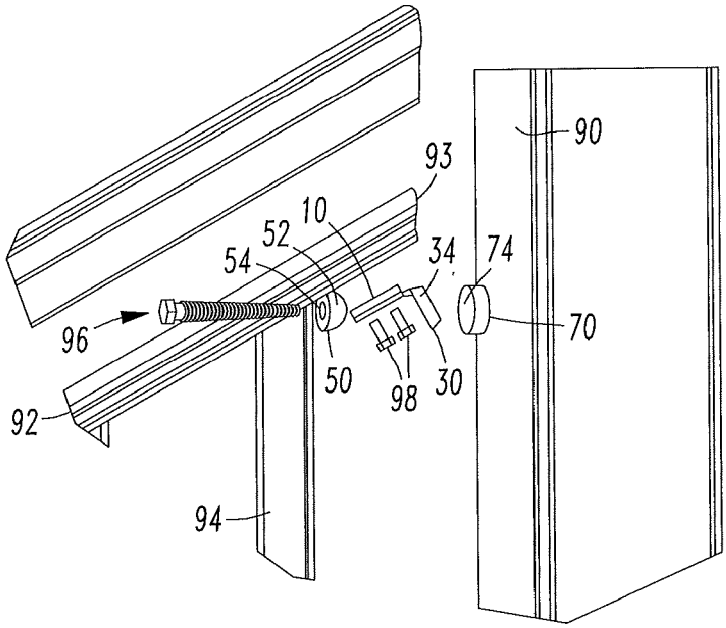
FIG. 5 is an exploded view of an embodiment of the universal handrail support bracket forming a butt joint between a rail member and a fixed substantially vertical surface.
Figure 6:
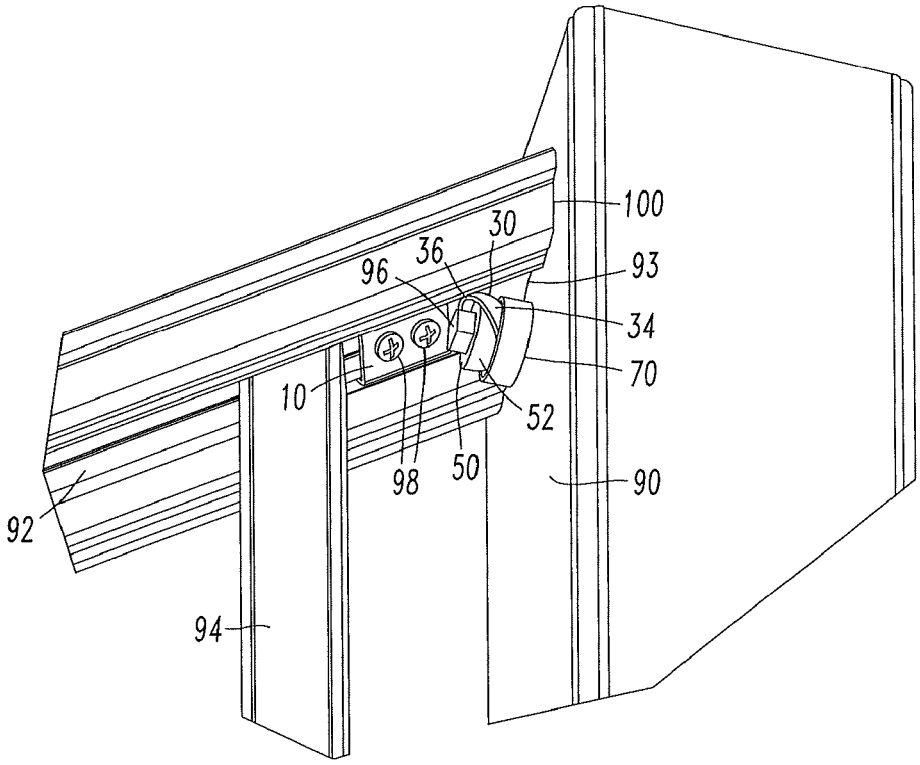
FIG. 6 is a perspective view illustrating an embodiment of the universal handrail support bracket installed between a rail member and a fixed substantially vertical surface.

A preferred method of using embodiments of the universal handrail support bracket may be appreciated from FIGS. 5-6. A rail member 92, such as a handrail or banister, and a fixed substantially vertical surface 90, such as a wall or newel post, are positioned together at a desired pitch angle, yaw angle, and roll angle. The rail member 92 may be supported for example by one or more vertical supports or balusters 94.

A bracket 10 with an attached annular ring 30 as described above may be used to attach the rail member 92 to the fixed substantially vertical surface 90 and form a butt joint between an end 93 of the rail member 92 and the fixed substantially vertical surface 90. In most situations the rail member 92 will be in a plane forming a substantially ninety degree angle with the substantially vertical surface 90 after installation. However, the connector shown in the drawings permits the rail member to be attached at other angles.

The curved nut 50 as described above is positioned within the annular ring 30 and the cap 70 as described above is positioned on or over the annular ring 30. The bracket 10 is mounted to the rail member 92 so that the annular ring 30 is adjacent to the fixed substantially vertical surface 90 via for example screws 98 through screw holes 12 respectively. Although less preferred, it is also contemplated that the bracket 10 may be mounted to the rail member 92 via other means, such as for example adhesives like epoxy or glue, or other fastening mechanisms.

A fastener, such as for example a screw 96, is passed through the central bore 54 of the curved nut 50, the annular ring 30, and the aperture 78 of the cap 70. The front surface 72 of the of the cap 70 is positioned against the fixed substantially vertical surface 90 until flush. It may be necessary to adjust the pitch angle, the yaw angle, and the roll angle of the curved nut 50 and the cap 70 when positioning the cap 70 against the fixed substantially vertical surface 90. The fastener 96 is then driven into the fixed substantially vertical surface 90. The fastener 96 may be driven through the curved nut 50, the annular ring 30, the cap 70, and into the fixed substantially vertical surface 90, as may be appreciated from FIG. 6, which shows the universal handrail support bracket installed in accordance with the preferred embodiment. Use of the connector in this manner will form a butt joint 100 between the end 93 of the rail member 92 and the fixed substantially vertical surface 90 with no gap or no noticeable gap therebetween. The ability to minimize or eliminate such a gap permits embodiments of the universal handrail support bracket to provide a desirable butt joint that has a desired aesthetic effect.

Because adjustment of the pitch angle, the yaw angle, and the roll angle may be required when positioning the cap 70 against the fixed substantially vertical surface 90, the fastener 96 may be inserted into the curved nut 50 so that it forms oblique angles with any surface of the bracket 10 or the rail member 92.

This preferred method of using embodiments of the universal handrail support bracket allows the installer to form a tight butt joint 100 between the end 93 of the rail member 92 and the fixed substantially vertical surface 90 even in the case that the fixed substantially vertical surface 90 is warped. Such warping of the fixed substantially vertical surface 90 may be compensated for by adjusting the yaw angle of the bracket 10 by rotating and pivoting both the curved nut 50 positioned within the annular ring 30 and the cap 70 positioned on or over the annular ring 30. It is further preferred that the front surface 72 of the cap 70 be positioned flat on the fixed substantially vertical surface 90 to engage against the fixed substantially vertical surface 90. If the surface of the fixed substantially vertical surface 90 is curved, it is considered that the front surface 72 of the cap 70 may be curved to mate with the fixed substantially vertical surface 90.

It should be appreciated that other variations of the present preferred embodiments discussed above may be made. For example, it is contemplated that the front surface 72 of the cap 70 may be sized and configured to allow the cap 70 to mate with a fixed substantially vertical surface 90 which may have any number of configurations or shapes. As another example, the annular ring 30 may be positioned on the bracket 10 other than at an end 18 of the bracket 10, and the front face 36 of the annular ring 30 may have a smaller interior diameter than the interior diameter of the rear face 38.

While certain present preferred embodiments of my universal handrail support bracket and certain embodiments of practicing and making the same have been shown and described, it is to be distinctly understood that the invention is not limited thereto but may be otherwise variously embodied and practiced within the scope of the following claims.

I claim:

1. A connector assembly for creating a butt joint between a rail member and a fixed substantially vertical surface comprising:

a. a bracket configured to be mounted to a rail member and having a width;

b. an annular ring having a concave interior surface, a convex exterior surface, a front face, and a rear face, the front face having an interior diameter;

c. a bendable tab having a width narrower than the width of the bracket, extending from the front face of the annular ring and attached to the bracket;

d. a curved nut having a convex front surface that mates with the concave interior surface of the annular ring and a central bore extending through the curved nut, the curved nut being positioned within the annular ring so that the curved nut may freely rotate and pivot within the annular ring; and e. a cap having a concave interior surface that defines a chamber that mates with the convex exterior surface of the annular ring, and a front surface having an aperture communicating with the chamber and having a smaller interior diameter than the interior diameter of the front face of the annular ring, the cap being positioned over the annular ring such that the cap may freely rotate and pivot on the annular ring, the aperture being aligned with the central bore of the curved nut.

2. The connector assembly as claimed in claim 1 wherein the front face of the annular ring defines a first plane, the bracket has a width and a length which define a second plane, and the first plane and the second plane intersect at a substantially ninety degree angle.

3. The connector assembly as claimed in claim 1 wherein the front surface of the cap is flat.

4. The connector assembly as claimed in claim 1 wherein the cap is substantially cylindrical.

5. The connector assembly as claimed in claim 1 wherein the bracket and the annular ring are an integrally formed unit.

6. The connector assembly as claimed in claim 1 wherein at least one of the bracket and the annular ring are made of a metal selected from the group consisting of aluminum, iron, brass, steel, stainless steel, or other metal alloy.

7. The connector assembly as claimed in claim 1 wherein at least one of the curved nut and the cap are made of a metal selected from the group consisting of aluminum, iron, brass, steel, stainless steel, or an alloy.

8. The connector assembly as claimed in claim 1 further comprising a fastener located through the central bore of the curved nut, the annular ring, and the aperture of the cap.

9. The connector assembly as claimed in claim 1 wherein the bracket has at least one hole for receiving a fastener.

10. The connector assembly as claimed in claim 1 wherein the bracket has parallel bent ends forming a channel, the channel extending from a first end of the bracket to a second end of the bracket that is opposite the first end.

11. The connector assembly as claimed in claim 10 wherein the channel is sized and configured to mate with a portion of the rail member.

12. The connector assembly as claimed in claim 1 wherein the central bore of the curved nut and the aperture of the cap are not threaded.

13. A connector assembly for creating a butt joint between a rail member and a fixed substantially vertical surface comprising:

a. a bracket configured to be mounted to a rail member;

b. an annular ring having a concave interior surface, a convex exterior surface, a front face, and a rear face, the front face having an interior diameter and a tab extending from the front face and attached to the bracket, wherein the tab is made of a bendable material and is of a width and a thickness such that the tab can bend and the annular ring can be moved relative to the bracket;

c. a curved nut having a convex front surface that mates with the concave interior surface of the annular ring and a central bore extending through the curved nut, the curved nut being positioned within the annular ring so that the curved nut may freely rotate and pivot within the annular ring; and d. a cap having a concave interior surface that defines a chamber that mates with the convex exterior surface of the annular ring, and a front surface having an aperture communicating with the chamber and having a smaller interior diameter than the interior diameter of the front face of the annular ring, the cap being positioned over the annular ring such that the cap may freely rotate and pivot on the annular ring, the aperture being aligned with the central bore of the curved nut.

14. A rail system comprising a railing attached to a fixed substantially vertical surface by a connector the connector comprised of:

a. a bracket attached to the railing and having a width;

b. an annular ring having a concave interior surface, a convex exterior surface, a front face, and a rear face, the front face having;

c. a bendable tab having a width narrower than the width of the bracket, extending from the front face of the annular ring and attached to the bracket;

d. a curved nut having a convex front surface that mates with the concave interior surface of the annular ring and a central bore extending through the curved nut, the curved nut being positioned within the annular ring so that the curved nut may freely rotate and pivot within the annular ring;

e. a cap having a concave interior surface that defines a chamber that mates with the convex exterior surface of the annular ring, and a front surface having an aperture communicating with the chamber, the cap being positioned on or over the annular ring such that the cap may freely rotate and pivot on the annular ring; and f. a fastener positioned through the bore of the curved nut, the annular ring, and the bore of the cap through the substantially vertical surface.

* * * * *